US008887608B1

(12) United States Patent
Morein

(10) Patent No.: US 8,887,608 B1
(45) Date of Patent: Nov. 18, 2014

(54) CLEAVER AND CUTTING BOARD COMBINATION WITH SELF-LOCKING HINGE

(76) Inventor: Jason P. Morein, Sunset, LA (US)

( * ) Notice: Subject to any disclaimer, the term of this patent is extended or adjusted under 35 U.S.C. 154(b) by 88 days.

(21) Appl. No.: 13/324,797

(22) Filed: Dec. 13, 2011

Related U.S. Application Data

(60) Provisional application No. 61/422,291, filed on Dec. 13, 2010.

(51) Int. Cl.
*B26D 5/08* (2006.01)

(52) U.S. Cl.
USPC ..... 83/607; 83/564

(58) Field of Classification Search
USPC ..... 83/471.3, 563, 564, 605, 607–609; 30/296.1, 342
See application file for complete search history.

(56) References Cited

U.S. PATENT DOCUMENTS

| | | | | | |
|---|---|---|---|---|---|
| 159,714 | A * | 2/1875 | Smith | 83/468 |
| 2,563,741 | A * | 8/1951 | Patton | 83/136 |
| 3,955,278 | A | 5/1976 | Popeil | |
| 4,054,994 | A * | 10/1977 | Grossman | 30/296.1 |
| 4,247,984 | A | 2/1981 | McArdle et al. | |
| 6,318,222 | B1 | 11/2001 | Weinman, Jr. | |
| 6,564,685 | B1 | 5/2003 | Beaton | |
| 2002/0096814 | A1 * | 7/2002 | Wong | 269/289 R |
| 2004/0007108 | A1 * | 1/2004 | Fregeolle et al. | 83/13 |

* cited by examiner

*Primary Examiner* — Kenneth E. Peterson
*Assistant Examiner* — Samuel A Davies
(74) *Attorney, Agent, or Firm* — Greg R. Mier

(57) ABSTRACT

An apparatus for cutting food items. The apparatus includes a cleaver, a cutting board, and a hinge that connects the cleaver to the cutting board. When these three components are used together, the apparatus provides greater cutting ability than conventional kitchen knifes and cutting boards. The apparatus is designed to cut through fish and poultry bones, frozen foods, and other food items that are typically difficult to cut.

7 Claims, 5 Drawing Sheets

CLEAVER AND CUTTING BOARD COMBINATION WITH SELF-LOCKING HINGE

FIELD OF THE INVENTION

The subject invention relates generally to cutting boards used to cut food articles such as vegetables, fruits and meat.

BACKGROUND

Cutting boards for use in cutting various types of foodstuffs are well known, as are several types of knives to be used in combination with such boards. An example of a cutting board in the prior art includes the one disclosed in U.S. Pat. No. 3,955,278, issued on May 11, 1976 to Samuel Jr. Popeil. Another example of a cutting board in the prior art includes the one disclosed in U.S. Pat. No. 6,318,222, issued on Nov. 20, 2011 to Joseph B. Weinman, Jr.

SUMMARY OF INVENTION

The present invention includes a cleaver, a cutting board, and a hinge that connects the cleaver to the cutting board. When these three components are used together, the present invention provides greater cutting ability than conventional kitchen knifes and cutting boards. The present invention is designed to cut through fish and poultry bones, frozen foods, and other food items that are typically difficult to cut.

The cleaver of the present invention is designed to work in tandem with the cutting board and hinge. Similar designs use more of a conventional kitchen knife with only a hole in the tip. These knives also use rounded or curved edges which limit their effectiveness by allowing for a much smaller contact area with the food. Because of these limitations, other designs are not as efficient as the present invention.

The present invention uses a flat, non-curved cutting edge with a slight rise from neck to handle. When used within the groove on the surface of the cutting board, the non-curved cutting edge provides for a continuous cutting motion through the entire cutting cycle. The angled neck and keys are designed to enhance the effectiveness of the cleaver by being separate from the cutting edge. The keys work with the hinge to hold the cleaver in a vertical position when locked into place. The handle is used to grip the cleaver and as the area to which the downward force is applied. The handle grips can be composed of plastic, wood, or other suitable material.

The cutting board is equipped with a clip for the attachment of the hinge, a groove under the cleaver, a measuring tool, and a fluid channel.

BRIEF DESCRIPTION OF THE DRAWINGS

The accompanying drawings are provided for the purpose of illustration only and are not intended as a definition of the limits of the present invention. The drawings illustrate a preferred embodiment of the present invention, wherein.

DESCRIPTION OF THE INVENTION

While the present invention will be described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the present invention not be limited to the particular embodiments disclosed as the best mode contemplated for carrying out this invention, but that the invention will include all embodiments (and legal equivalents thereof).

Figure 1:
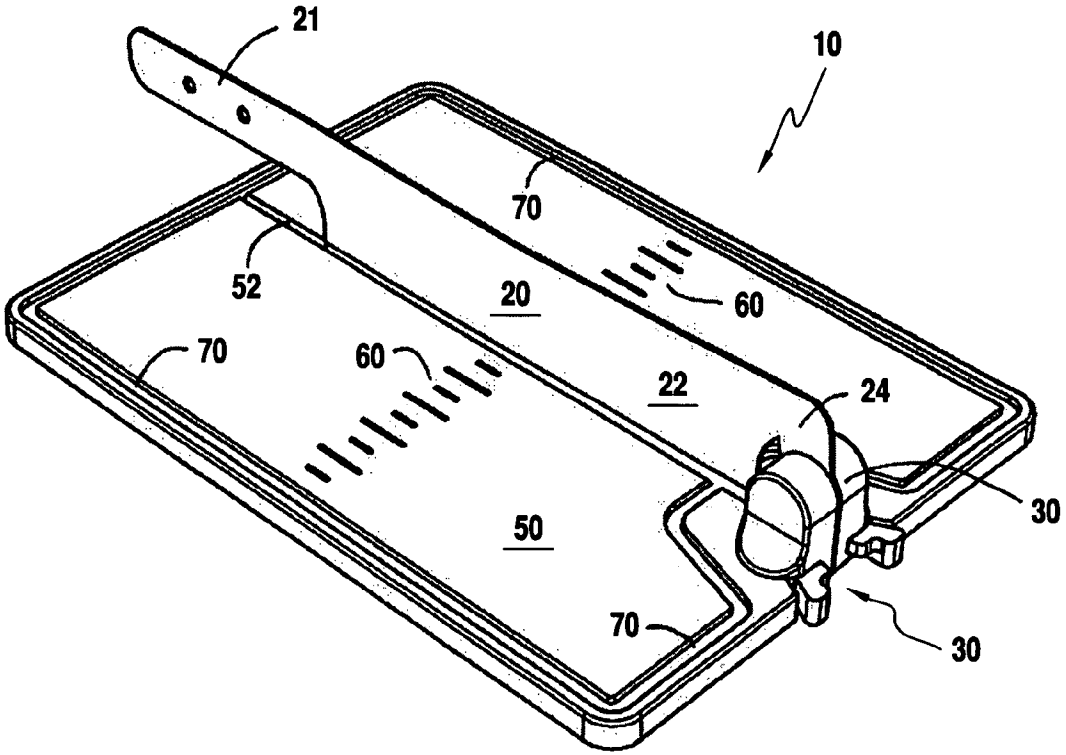
FIG. 1 is an isometric view of the present invention with the cleaver in the down position.
Figure 2:
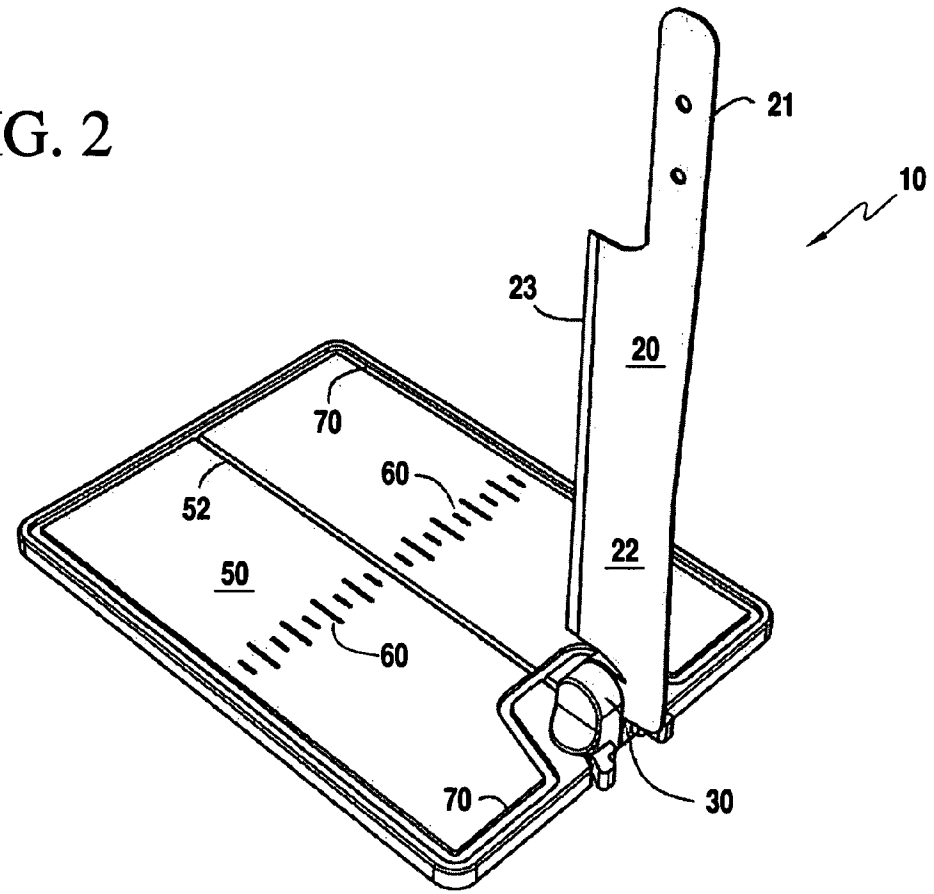
FIG. 2 is an isometric view of the present invention with the cleaver in the up and locked position.

As shown in FIGS. 1 and 2, the preferred embodiment of the present invention 10 includes the following primary components: a cleaver 20, a hinge 30, and cutting board 50.

Figure 4:
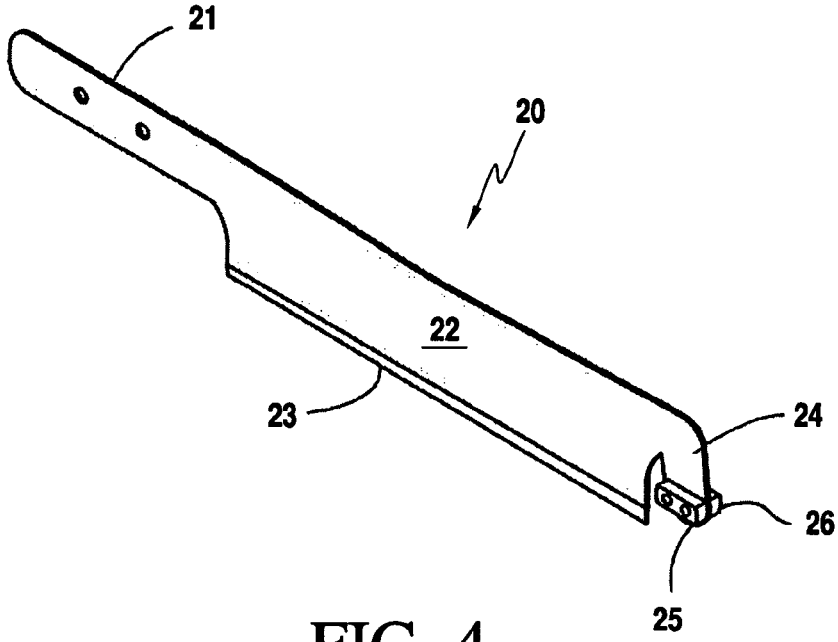
FIG. 4 is an isometric view of the cleaver of the present invention.

As shown in FIG. 4, cleaver 20 has an elongated handle 21, an elongated blade 22, a cutting edge 23, and an angled neck 24 with keys 25 and 26 attached opposite each other on the end of angled neck 24. This design accomplishes several things, including (1) allowing for the attachment of the hinge mechanism, (2) providing minimal interference with the cutting surface, and (3) providing a comfortable grip of elongated handle 21.

Figure 3:
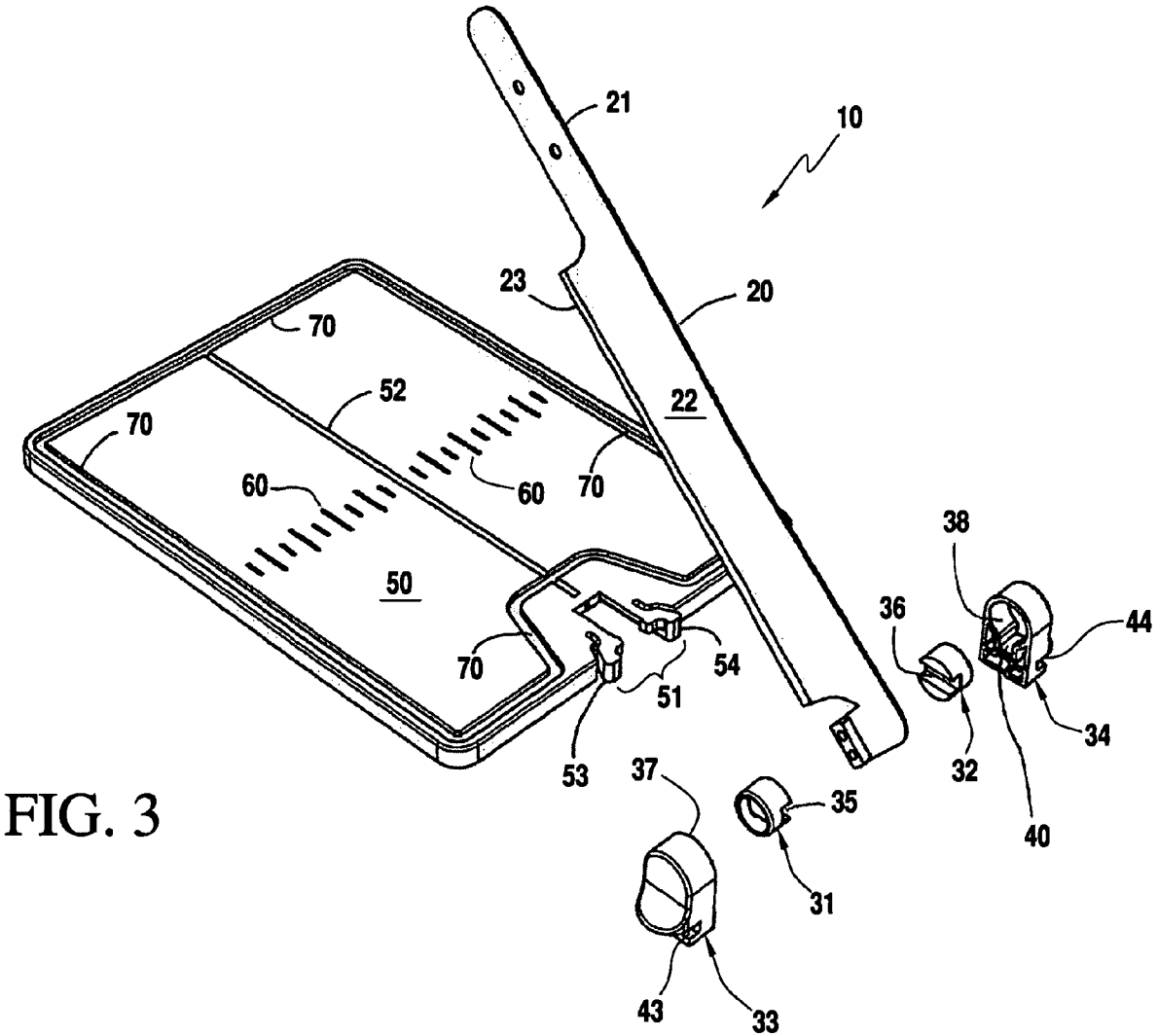
FIG. 3 is an exploded, isometric view of the present invention.
Figure 5:
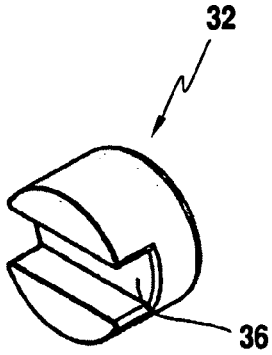
FIG. 5 is an isometric view of the bearing of the present invention.
Figure 6:
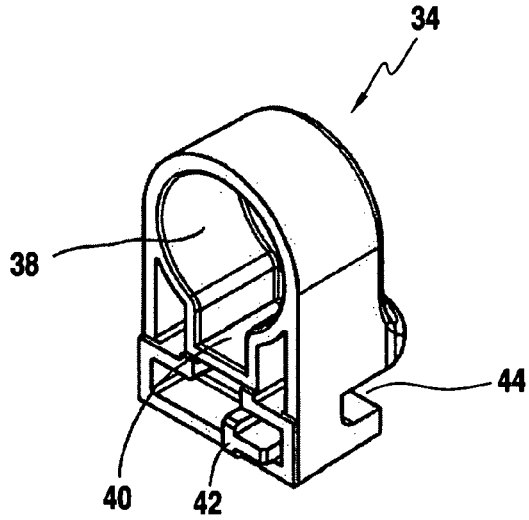
FIG. 6 is an isometric view of the housing component of the present invention.
Figure 7:
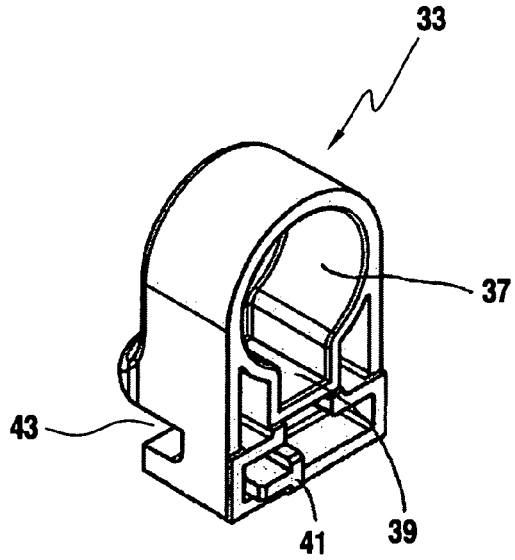
FIG. 7 is an isometric view of the housing component of the present invention.

As shown in FIG. 3, hinge 30 is made of two bearings 31 and 32 and two housing components 33 and 34. As shown in FIGS. 3 and 5, bearings 31 and 32 have grooves 35 and 36, respectively, in which keys 25 and 26 of cleaver 20 slidably fit when the components of hinge 30 are pieced together. As shown in FIGS. 3, 6, and 7, housing components 33 and 34 have openings 37 and 38, respectively, in which bearings 31 and 32 rotatably fit when the components of hinge 30 are pieced together. Openings 37 and 38 are equipped with slots 39 and 40 (shown in FIGS. 3, 6, and 7), respectively, so that when cleaver 20 is rotated upwardly to a substantially vertical position, as shown in FIG. 2, keys 25 and 26 drop down into slots 39 and 40, thereby locking cleaver 20 in a substantially vertical position. When keys 25 and 26 drop down into slots 39 and 40, respectively, bearings 31 and 32 are prevented from rotating within housing Components 33 and 34. Cleaver 20 is unlocked from its substantially vertical position by lifting cleaver 20 until keys 25 and 26 rise out of slots 39 and 40, respectively, thereby allowing bearings 31 and 32 to rotate in housing components 33 and 34.

As shown in FIGS. 6 and 7, a first tab 41 and a second tab 42 attached to housing components 33 and 34, respectively, allow the components of hinge 30 to be held together. Housing components 33 and 34 have openings 43 and 44, respectively, which allow hinge 30 and cleaver 20 to be securely fastened to cutting board 50.

As shown in FIG. 3, cutting board 50 has a clip 51 for removably attaching hinge 30 and cleaver 20. Clip 51 allows removal of hinge 30 and cleaver 20 for storage and cleaning. Clip 51 is preferably equipped with first arm 53 for removably fixing housing component 33 to cutting board 50 and with second arm 54 for removably fixing housing component 34 to cutting board 50. Cutting board 50 may also be equipped with a groove 52 which runs the length of blade 22. Groove 52 is designed to maximize the cutting ability by concentrating the force of cutting edge 23 into a very precise cutting area, which allows cutting edge 23 and blade 22 to completely penetrate the item being cut on cutting board 50. Groove 52 also keeps cutting edge 23 and blade 22 properly aligned when the present invention is in use.

In use, hinge 30 acts as the fulcrum, while cleaver 20 acts as a lever. This combination generates increased cutting forces for cutting difficult to cut food items with less effort.

The present invention may also include an integrated graduated measuring tool 60 that allows the user to measure precise cuts. Measuring tool 60 preferably runs in both directions on cutting board 50 perpendicular to cleaver 20. The present invention may also include a fluid channel 70 that runs along the perimeter of cutting board 50. Fluid channel 70 is preferably used to collect the fluids which may escape the food as it is being processed on the cutting board 50.

It will be also understood that one embodiment of the present invention has been disclosed by way of example and that other modifications and alterations may occur to those skilled in the art without departing from the scope and spirit of the present invention and the accompanying claims.

What is claimed is:

1. An apparatus for cutting food items, said apparatus comprising:

(a) a cutting board with a substantially flat surface, a perimeter, and at least one edge;

(b) a clip on said at least one edge of said cutting board;

(c) a hinge comprising a first housing component removably fixed to said clip and a second housing component removably fixed to said clip opposite said first housing component, said first housing component having a substantially round first opening facing said second housing component and said second housing component having a substantially round second opening facing said first housing component, said first housing component having a first slot adjacent to said first opening and said second housing component having a second slot adjacent to said second opening;

(d) a first bearing rotatably positioned inside said first opening of said first housing component and a second bearing rotatably positioned inside said second opening of said second housing component opposite said first bearing, said first bearing having a first groove facing said second bearing and said second bearing having a second groove facing said first bearing;

(e) an elongated cleaver having a first end and a second end, said elongated cleaver having a blade with a cutting edge extending between said first end, and said second end, said cleaver having an angled neck extending from said first end, said angled neck having a first side and a second side, said angled neck having a first key fixed to said first side and a second key fixed to said second side, where said first key fits into said first groove of said first bearing and said second key fits into said second groove of said second bearing, where said first and second keys removably slide into said first and second slots when said first and second grooves are aligned with said first and second slots; and (f) a handle extending from said second end of said elongated cleaver.

2. The apparatus of claim 1, where said clip comprises a first arm for removably fixing said first housing component to said cutting board, and a second arm for removably fixing said second housing component to said cutting board.

3. The apparatus of claim 2, where said first housing component comprises a first cavity for receiving said first arm of said clip, and where said second housing component comprises a second cavity for receiving said second arm of said clip.

4. The apparatus of claim 3, where said first and second housing components comprise first and second tabs, respectively, for securely holding first and second housing components together.

5. The apparatus of claim 4, where said substantially flat surface of said cutting board comprises a groove aligned with said blade of said elongated cleaver.

6. The apparatus of claim 5, where said substantially flat surface of said cutting board comprises a graduated measuring tool perpendicular to said groove.

7. The apparatus of claim 6, where said substantially flat surface of said cutting board comprises a fluid channel along said perimeter of said cutting board.

* * * * *